US006505736B2

(12) United States Patent
Donovan

(10) Patent No.: US 6,505,736 B2
(45) Date of Patent: Jan. 14, 2003

(54) GARMENT STORAGE APPARATUS AND SYSTEM

(76) Inventor: Brian J. Donovan, 21 Beacon St., Boston, MA (US) 02108

( * ) Notice: Subject to any disclaimer, the term of this patent is extended or adjusted under 35 U.S.C. 154(b) by 0 days.

(21) Appl. No.: 09/751,990

(22) Filed: Dec. 29, 2000

(65) Prior Publication Data

US 2002/0084199 A1 Jul. 4, 2002

(51) Int. Cl.[7] ..... B65D 85/12
(52) U.S. Cl. ..... 206/292; 190/100; 190/18 A
(58) Field of Search ..... 206/292, 298, 206/287, 287.1, 279, 280; 190/100, 102, 111, 13 R, 18 A

(56) References Cited

U.S. PATENT DOCUMENTS 1,668,358 A * 5/1928 De Luca ..... 190/18 A
1,954,607 A * 4/1934 Weary et al. ..... 190/41
4,662,513 A * 5/1987 King et al. ..... 206/287.1
4,863,018 A * 9/1989 King et al. ..... 206/290
4,925,021 A * 5/1990 Pulichini, Jr. ..... 206/279
4,998,603 A * 3/1991 Nordstrom ..... 190/18 A
5,505,297 A * 4/1996 Myers ..... 206/279
5,535,880 A * 7/1996 Plath ..... 206/298
5,566,797 A * 10/1996 Van Himbeeck ..... 190/18 A
5,628,397 A * 5/1997 Ham ..... 206/278.1

* cited by examiner

*Primary Examiner*—Stephen P. Garbe
*Assistant Examiner*—Lien Ngo
(74) *Attorney, Agent, or Firm*—Michael J. Persson; Lawson, Philpot & Persson, P.C.

(57) ABSTRACT

A garment storage apparatus that includes a housing having a first portion, a second portion, and a central portion. The first portion and the second portion are dimensioned to fold about the central portion and fasten together to form an interior compartment of the apparatus. The combination of a clamp plate, a clamping means, a central rod assembly and a second rod assembly holds a garment in tension when the first portion of the housing and the second portion of the housing are folded about the central portion of the housing.

12 Claims, 5 Drawing Sheets

GARMENT STORAGE APPARATUS AND SYSTEM

FIELD OF THE INVENTION

The present invention relates to the field of garment storage and, in particular, to a garment storage apparatus and system for minimizing wrinkling of stored garments.

BACKGROUND OF THE INVENTION

It is well known that garments placed in storage devices of all types become wrinkled over a period of time. Accordingly, it is common for a business traveler to pack a garment bag, suitcase, and/or carry-on luggage with clothing needed for a trip and, upon arriving at a destination, finding that the clothing that had been originally wrinkle-free when loaded into the storage device now looks like it was "slept in." This is particularly acute for a business traveler who must go from destination to destination and look sharp and neat at each stop.

In addition to wrinkling during travel, the lack of a device for keeping suits "wrinkle" free during transport often causes businesspeople who visit a gym or other club after working hours to leave the gym in their business clothes in order to avoid having to dry clean their clothing to eliminate the wrinkles and/or odors.

There are a number of devices available for transporting garments, but none that is adapted for use by both the business traveler and the businessperson that engages in activities after work. For example, it is generally recognized that a full-length garment bag is the most effective mechanism in the prior art for avoiding wrinkling of hanging clothes. However, these bags are bulky and are not readily adapted for easy transportation on subways or the like. Further, storage of such a bag on a commercial aircraft or gym locker requires that the bag be folded, which defeats the benefits of use of a full-length bag.

In response to the problems attendant to full length garment bags, a number of folding garment bags have been developed, with compartments for shirts, socks, and other articles of clothing. However, such luggage still represents an essential compromise between the goal of wrinkle-free transportation of fine articles of clothing and the ability to carry one's luggage into the cabin of an airplane.

It is also known in the prior art of luggage to incorporate apparatus for holding coat hangers on at least one interior wall of a hard sided relatively large suitcase so that most suits, dresses, and the like can be stored in the suitcase on a hanger, folded once. Furthermore, some suitcases have included a panel that has a thick wire frame on the perimeter for laying on top of the portion of hanging clothing that lays within the interior well of one side of such a suitcase. In typical usage, the parts of the hanging clothes that hang below the lower edge of such a panel are folded over the wire edge of the panel and then other clothing may be inserted. It is also known to include a selectively closeable flap for holding the packed assembly in the interior well of one side of the suitcase so that all the clothing articles do not fall out when the suitcase is opened. However, such suitcases have been of relatively large size, and are not suited for carryon luggage, storage in a gym locker, or transport on subways.

A number of United States Patents have been issued relating to the storage and transport of garments. However, each has drawbacks that make them unsuited to solve the above-identified problem. For example, U.S. Pat. No. 3,542,1710, titled "Article of Luggage", discloses a portable wardrobe that carries articles of clothing in an extended position upon a locking garment support bar. This article is essentially a variation of the folding full-length garment bag discussed above in which a specialized hanger is utilized to hold the clothing in position. However, because of the lack of support for the clothing within the bag, this design does not solve the wrinkling problem. Further, the relatively large size of the article makes it unsuitable for use as a carry-on, or for storage in a gym locker.

U.S. Pat. No. 3,737,013 titled "Garment Case with Hangar Like Support", discloses a flexible garment case having a rigid support member attached to the outsides of the midsection of the bag. In operation the support member is locked in place and the bag is folded over it. However, the fact that the support member is only disposed along the central portion of the outside of the bag means that the clothing is free to move within the bag, causing wrinkles. Further, the relatively large size of the case again makes it unsuitable for use as a carry-on, or for storage in a gym locker.

U.S. Pat. Nos. 4,662,513 and 4,738,360, each titled "Garment Bag with Improved Packing Capability", disclose a garment bag having a pair of straps attached to a rotatable bar for holding clothing in place. The bar and straps act to hold the bottom end of the clothing while it is folded over itself. However, there is no means for holding the clothing along the fold line, which inherently causes wrinkles. Further, as was the case with the other bags, these bags are too large for use as a carry-on, or for storage in a gym locker.

U.S. Pat. No. 5,419,432, titled "Garment Bag for Dresser", discloses a garment bag the includes hangar holders at one end and an adjustable hem clasp mechanism at the other end for holding the hems of dresses in place. This hem clasp holds the clothing an extended position during transport and, therefore, this bag does not suffer from the wrinkling problems of the other cited bags. However, as this bag is essentially a variation of the typical "fold over" style garment bag, it is too large for use as a carry-on, or for storage in a gym locker.

U.S. Pat. No. 5,505,297, titled "Garment Bag Construction to Minimize Wrinkling" discloses a bag with a pair of Velcro closures and rigid wall portions that immobilize clothing and greatly reduce wrinkling. However, it is again of too large a size for use as a carry-on, or for storage in a gym locker.

Finally, U.S. Pat. No. 5,628,397, titled "Garment Bag with Cylindrical-Shaped Packing Compartments", discloses a garment bag that includes one or more semi-cylindrical shaped pockets that extend across the width of the bag and hold clothing in place when the bag is folded. Because the clothing is held in position once folded, this bag avoids some of the wrinkling problems of other designs. However, once again, it is too large for use as a carry-on, or for storage in a gym locker.

A garment storage apparatus that prevents wrinkling of clothing and is of a size that is readily adapted for use as a carry-on or for storage in a gym locker is not known in the art.

SUMMARY OF THE INVENTION

The present invention is a garment storage apparatus that overcomes the drawbacks of the prior art. In its most basic form, the apparatus includes a housing having a first portion made up of a first end and a first pair of sides, a second portion made up of a second end and a second pair of sides, and a central portion. Each of the first portion, the second portion and the central portion has an interior surface and an exterior surface. In addition, the first portion and the second portion are dimensioned to fold about the central portion and fasten together to form an interior compartment of the apparatus. A clamp plate is rotatably attached to the first end of the interior surface of the first portion of the housing and clamping means are provided for releasably engaging the clamp plate with the interior surface of the first portion of the housing. A central rod assembly is attached to the interior surface of the central portion of the housing. The central rod assembly includes a central rod that is disposed in substantially parallel relation with the ends of the housing. This central rod is manufactured of a material that allows the central rod to hold a garment in tension when the first portion and the second portion are folded about the central portion. A second rod assembly is attached to the interior surface of the second portion of the housing. The second rod assembly includes a second rod disposed in substantially parallel relation with the second end of the second portion of the housing. The second rod is also manufactured of a material that allows the second rod to hold a garment in tension when the first portion and the second portion are folded about the central portion.

In operation, a first end of a garment is disposed proximate to the clamp plate. A second end of the garment is then fed below the central rod assembly and the second rod assembly, folded back over the rods, and disposed proximate to the clamp plate and first end. The clamp plate is then engaged with the interior portion of the housing by the clamping means, causing the first end and the second end of the garment to be secured. The first portion and the second portion of the housing are then folded about the central portion and fastened together to allow the garment to be transported within the interior of the housing. Because the garment is held in tension about the rods by the clamping force exerted by the plate, the garment is not allowed to move within the apparatus and, consequently, remains in a substantially wrinkle free state during transport and storage.

In the preferred embodiment of the apparatus, the clamping means is a first rod assembly attached to the first interior surface of the first portion of the housing. The first rod assembly includes a first rod that is disposed at a position within the housing such that the first rod releasably engages the clamp plate with the interior surface of the first portion of the housing. It is preferred that the first rod assembly be dimensioned to allow the first end of the garment to be disposed in a position between the interior surface of the housing and the plate and to allow the second end of the garment to be disposed between the plate and the first rod. This prevents the surfaces of the garment from being clamped together and acts as a further precaution against wrinkling.

In the preferred embodiment, each rod assembly includes an adjustable arm joint and a clamp. However in other embodiments the central rod is a fixed and the garment is fed underneath the fixed central rod. In other embodiments, the second rod is fixed while, in still other embodiments, the central rod and second rod are both fixed rods about which the garment is fed.

The preferred rod assembly includes a plastic arm joint that rotates between a base position and a second position that is preferably at a forty-five degree angle from the base position. The preferred clamp is a plastic "C" type clamp that is dimensioned to allow the rod to be pressed into its opening and holds the rod in place.

It is likewise preferred that the apparatus include at least one hanging means for hanging said apparatus during storage, with the preferred embodiment including two such hanging means that are attached to the outside surface of the housing. The preferred apparatus also includes a handle, retractably attached to the exterior surface of the housing, for carrying said apparatus during transport.

Therefore, it is an aspect of the invention to provide a garment storage apparatus that prevents wrinkling of clothing.

It is a further aspect of the invention to provide a garment storage apparatus that is of a size that is readily adapted for use as a carry-on luggage during air travel.

It is a further aspect of the invention to provide a garment storage apparatus that is of a size that is readily adapted for storage in a gym locker.

It is a further aspect of the invention to provide a garment storage apparatus that allows multiple apparatus to be arranged in a single suitcase or other garment holding device.

It is a further aspect of the invention to provide a garment storage apparatus that is much lighter than other devices.

It is a further aspect of the invention to provide a garment storage apparatus that may be hung within a closet in a manner similar to traditional hangars.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
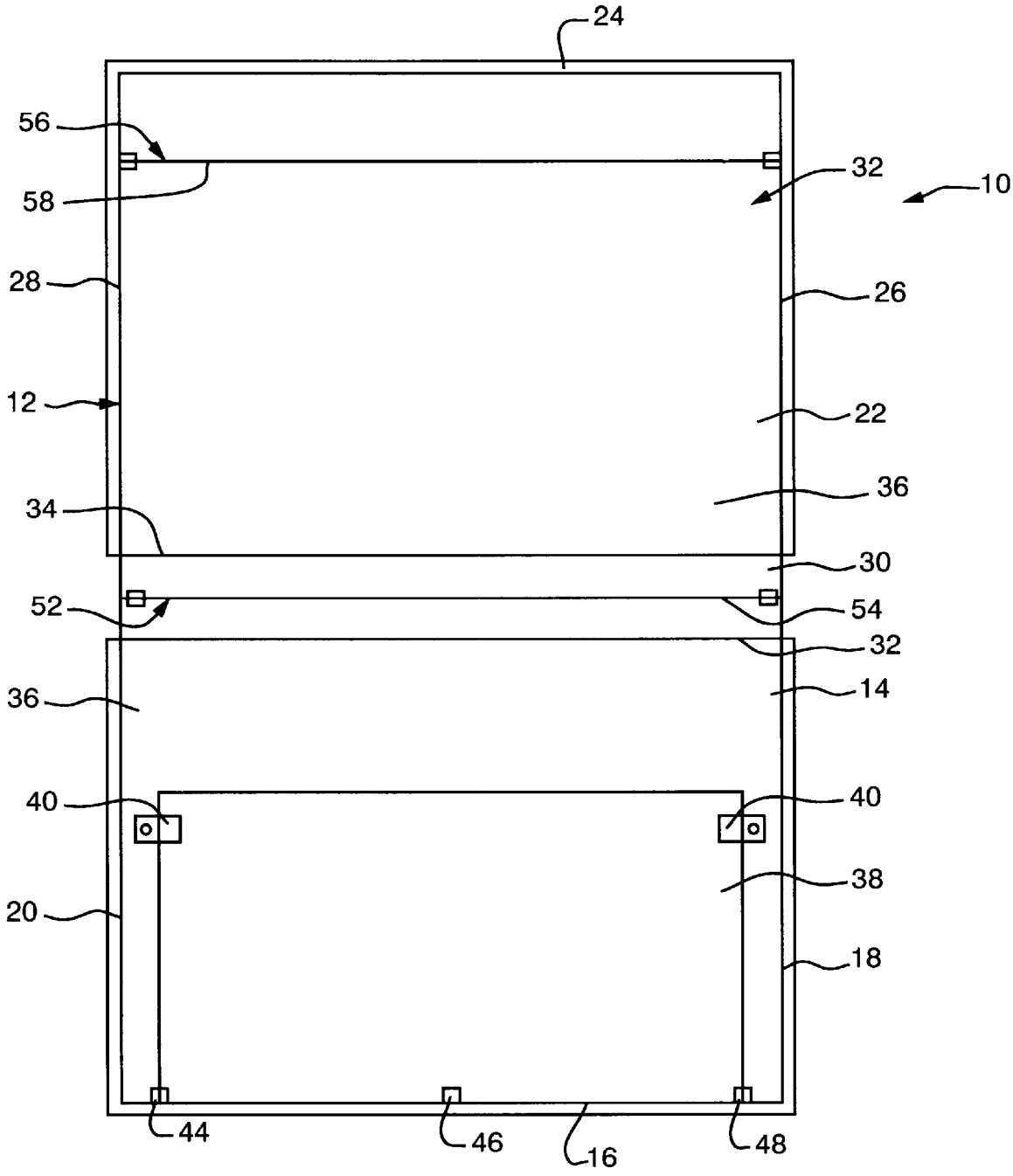
FIG. 1 is a top view of the one embodiment of the present invention in an open position showing the interior surface of the housing.

Referring first to FIG. 1, the garment storage apparatus 10 includes a housing 12 having a first portion 14 made up of a first end 16 and a first pair of sides 18, 20. A second portion 22 is also provided and is made up of a second end 24 and a second pair of sides 26, 28. The first portion 14 and second portion 22 are joined at a pair of folds 32, 34 by a central portion 30 of the housing 12. The first portion 14 and the second portion 22 are dimensioned to fold about the central portion 30 along the folds 32, 34 and fasten together to form an interior compartment of the apparatus 10. In this manner, the central portion 30 forms one side of the apparatus 10, while the first portion 14 and second portion 22 form the remaining five exterior sides.

Figure 6:
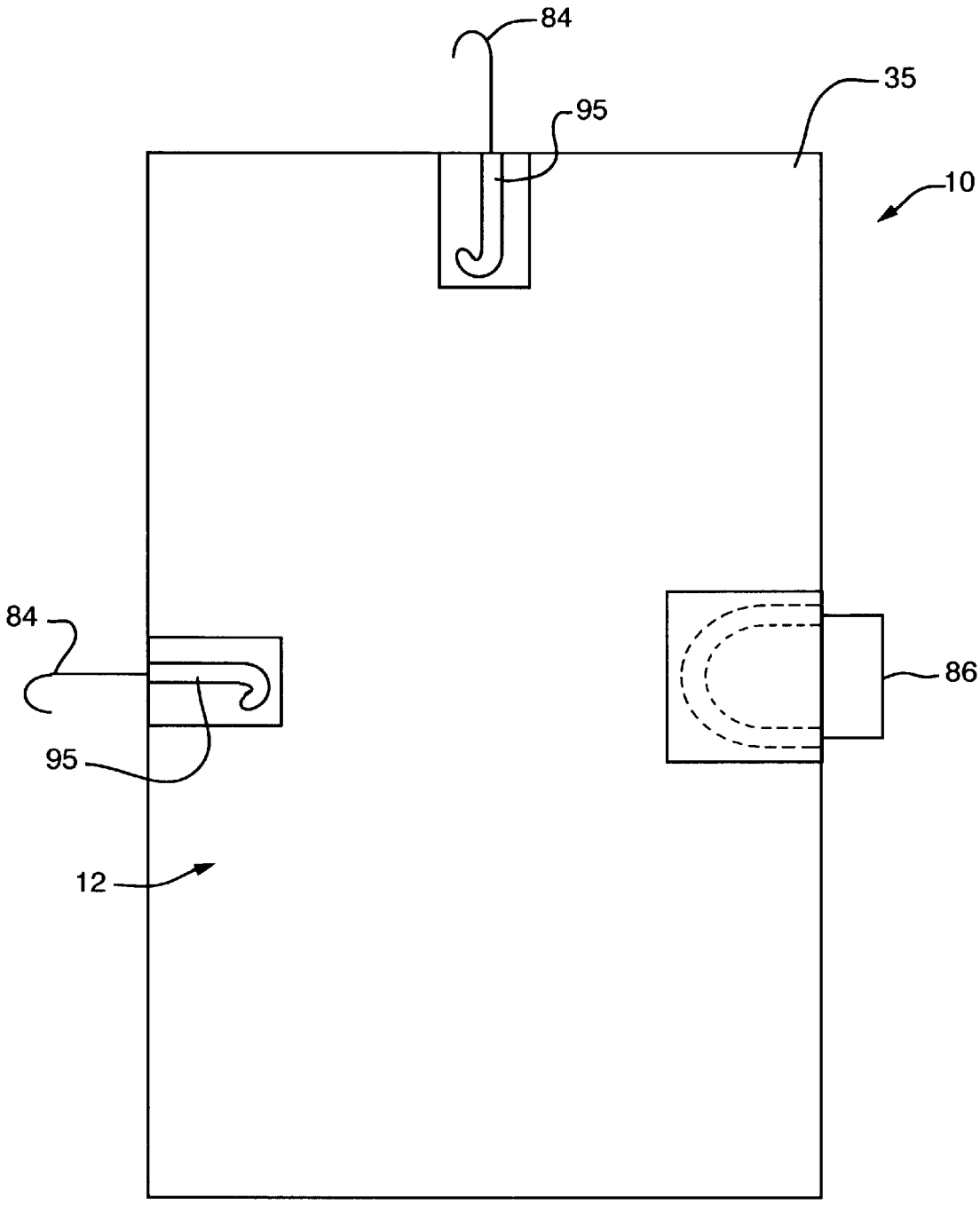
FIG. 6 is cut away side view of the exterior surface of the first portion of the preferred housing showing the retractable hanging means and retractable handle.

As is readily apparent, each portion 14, 22, 30 of the housing 12 has an interior surface 36 and an exterior surface 35 (shown in FIG. 6). In the preferred embodiment, the exterior surface of the housing is manufactured of rigid plastic and is substantially dentproof and water-resistant. However, it is recognized that other embodiments may include a flexible exterior surface manufactured of nylon, cloth, vinyl, or other material commonly used in the manufacture of luggage. The interior surface 36 of each portion of the housing 12 may be manufactured of the same material as the exterior surface, or may be lined with cloth, foam, or other art recognized cushioning material, provided that the material is not prone to wrinkling and will not cause the garments stored within the apparatus 10 to be wrinkled during use.

A clamp plate 38 is rotatably attached to the first end 16 of the interior surface 36 of the first portion 14 of the housing 12 and clamping means 40 are provided for releasably engaging the clamp plate 38 with the interior surface 22 of the first portion 14 of the housing 12. The preferred clamp plate 38 is manufactured of a substantially rigid plastic material having a thickness of about one quarter inch, a width of between about fourteen inches and eighteen inches measured between the sides 18, 20 of the first portion 14 of the housing, and a length of between about four inches and eight inches.

As shown in FIG. 1, the clamping means 40 are rotatable toe style clamps that are set to a desired height. However, in other embodiments, such as the embodiment of FIG. 2, the clamping means 40 is a first rod assembly 76, while in other embodiments, other art recognized clamping means are provided.

Figure 2:
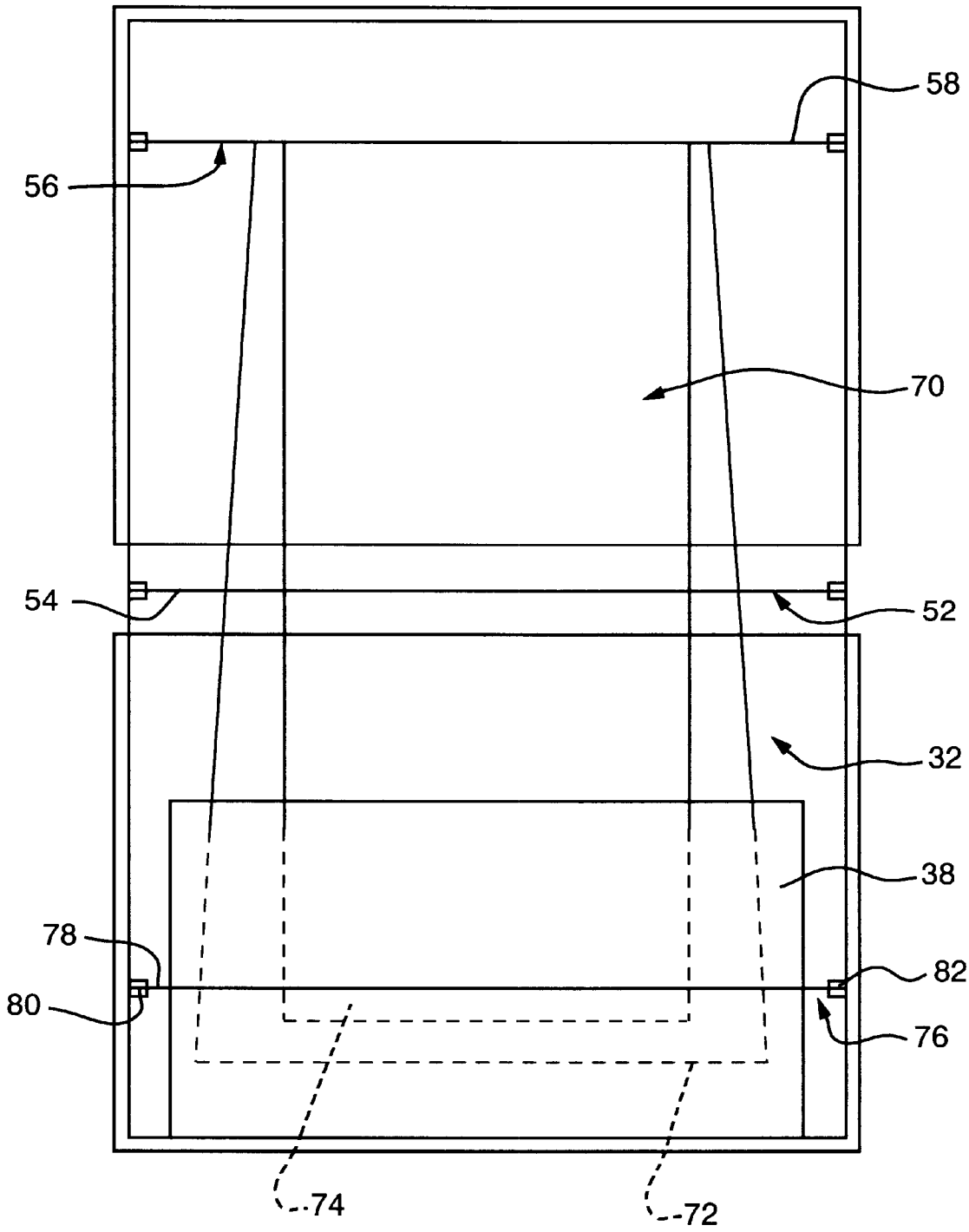
FIG. 2 is a top view of the preferred embodiment of the present invention in an open position showing the interior surface of the housing showing how a garment is secured therein.

In the embodiment of FIGS. 1 and 2, the clamp plate 38 is attached to, and rotates about, three mechanical hinges 44, 46, 48. However, in other embodiments, the clamp plate 38 may be attached to a single piano style hinge (not shown), a plurality of plastic or metal rings, a rotating hinge system such as those marketed for the binding of papers under the trademark "GBC", or to other art recognized means for providing rotation, provided such means allows the plate 38 to exert a clamping force when engaged with the interior surface 32 of the first portion 14 of the housing 12.

A central rod assembly 52 is attached to the interior surface 32 of the central portion 30 of the housing 12. The central rod assembly 52 includes a central rod 54 that is disposed in substantially parallel relation with the ends 16, 24 of the housing 12. The central rod 54 is manufactured of a material that allows the central rod 54 to hold a garment 70 (shown in FIG. 2) in tension when the first portion 14 and the second portion 22 are folded about the central portion 30. A second rod assembly 56 is attached to the interior surface 32 of the second portion 22 of the housing 12. The second rod assembly 56 includes a second rod 58 disposed in substantially parallel relation with the second end 24 of the second portion 22 of the housing 12. The second rod 58 is also manufactured of a material that allows the second rod 58 to hold a garment (shown in FIG. 2) in tension when the first portion 14 and the second portion 22 are folded about the central portion 32.

In the preferred embodiment, the rods 54, 58 are manufactured of a solid cylindrical plastic material having a diameter of between about one-quarter inch and three one inch. Such a material is preferred due to its lightweight and low cost. However, the present invention also contemplates the use of rods manufactured of metal, wood or composite materials. In some embodiments, the rods 54, 58 are solid rods, while in others they are hollow cylinders. In many embodiments, the rods 54, 58 are covered with rubber, cloth, foam, polyurethane, nylon or other art recognized cushioning material. The use of these covers (not shown) protects garments from damage due to imperfections in the rods.

The operation of the apparatus 10 is described with reference to FIG. 2. With the housing 12 in an open position, a first end 72 of a garment 70 is disposed proximate to the clamp plate 38. A second end 74 of the garment is then fed below the central rod assembly 52 and the second rod assembly 56, folded back over the rods 54, 58 of the central rod assembly 52 and second rod assembly 56, and is disposed proximate to the clamp plate 38 and first end 72 of the garment 70. The clamp plate 38 is then engaged with the interior portion 32 of the housing 12 by the clamping means 40, here a first rod assembly 76 having a first rod 78, causing the first end 72 and the second end 74 of the garment 70 to be secured within the apparatus 10. The first portion 18 and the second portion 22 of the housing 12 are then folded about the central portion 30 and fastened together to allow the garment 70 to be transported within the interior of the housing 12. Because the garment 70 is held in tension about the central rod 54 and second rod 58 by the clamping force exerted by the clamp plate 38, the garment 70 is not allowed to move within the apparatus 10 and, consequently, remains in a substantially wrinkle free state during transport and storage.

As shown in FIG. 2, the garment 70 is a pair of pants, the first end 72 is the waist portion of the pants, and the second end 74 is the hem of the pants. However, it is understood that the garment 70 also could be a suit jacket, dress or other article of clothing.

In some embodiments, the first rod assembly 76 be dimensioned to allow the first end 72 of the garment 70 to be disposed in a position between the interior surface 32 of the housing 12 and the clamp plate 38 and to allow the second end 74 of the garment 70 to be disposed between the clamp plate 38 and the first rod 78. This prevents the surfaces of the garment 70 from being clamped together and acts as a further precaution against wrinkling.

In the preferred embodiment, both the first end 72 of the garment 70 and the second end 74 of the garment 70 are disposed in a position between the interior surface 32 of the housing 12 and the clamp plate 38. This arrangement is preferred as it allows a wider variety of clamping means to be utilized. For example, in embodiments where the first rod assembly 76 may be dimensioned to fit within a groove or other detail (not shown) formed in the top surface of the clamp plate 38, the rod assembly 76 is not adapted to allow the second end 74 of the garment 70 to be positioned therebetween. Therefore, both ends 72, 74 of the garment 70 must be disposed between the interior surface 32 of the housing 12 and the clamp plate 38 in such an embodiment.

Figure 3:
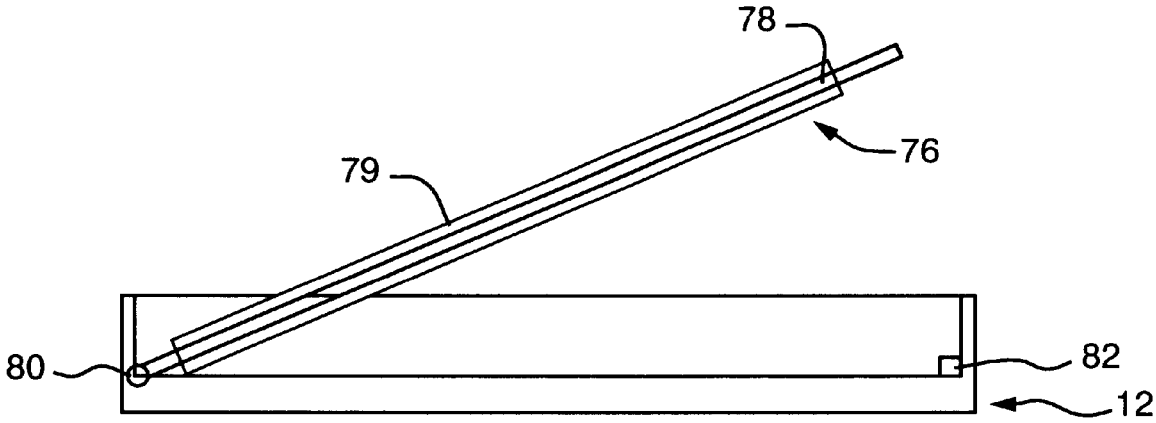
FIG. 3 is a cut away side view of the first end of the housing showing one embodiment of the first rod assembly.

In the preferred embodiment of the apparatus, shown in FIG. 2, the clamping means 40 is a first rod assembly 76. As described in detail with reference to FIG. 3, the first rod assembly 76 is similar in all respects to the central rod assembly 52 and second rod assembly 56 and includes a first rod 78 that is disposed at a position within the housing 12 such that the first rod 78 releasably engages the clamp plate 38 with the interior surface 32 of the first portion 18 of the housing 12. In the preferred embodiment, each rod assembly 52, 56, 76 includes an adjustable arm joint 80 and a clamp 82 that allow the rods 54, 58, 78 to be releasably clamped into position. However, in other embodiments, the first rod assembly 76 is adapted to be released and reclamped, while the central rod 54 and second rod 58 may be fixed rods 54, 58 about which the garment 70 is fed.

Figure 4:
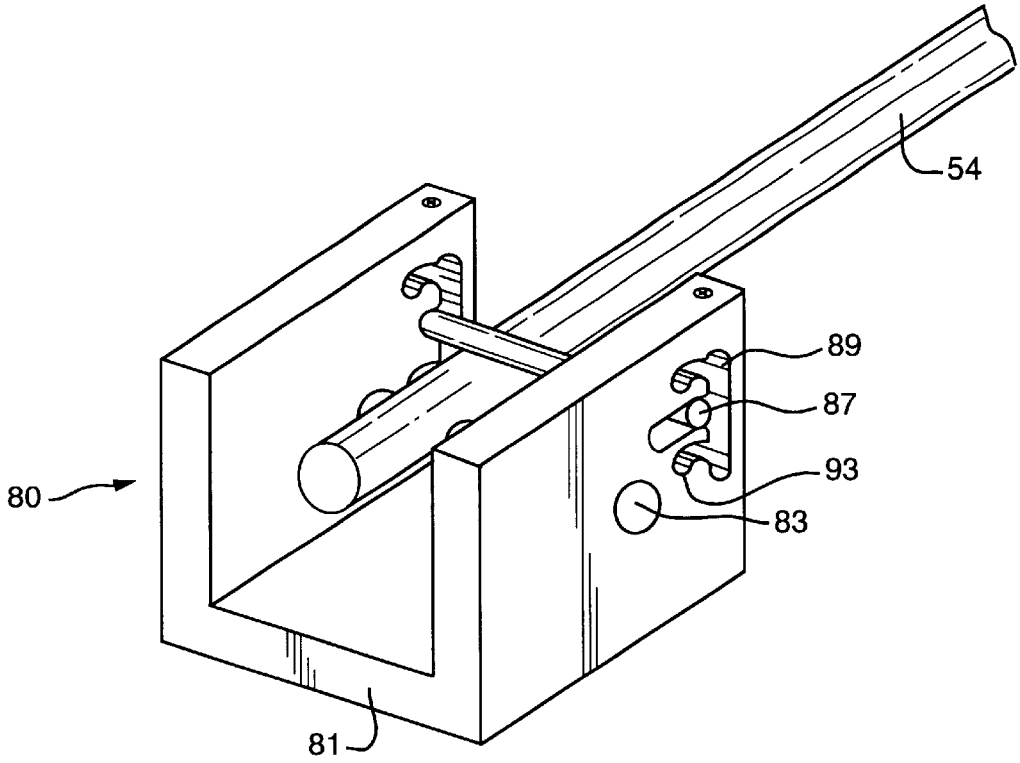
FIG. 4 is an exploded cut away view of the adjustable arm joint of the rod assembly of the embodiment of FIG. 3.
Figure 5:
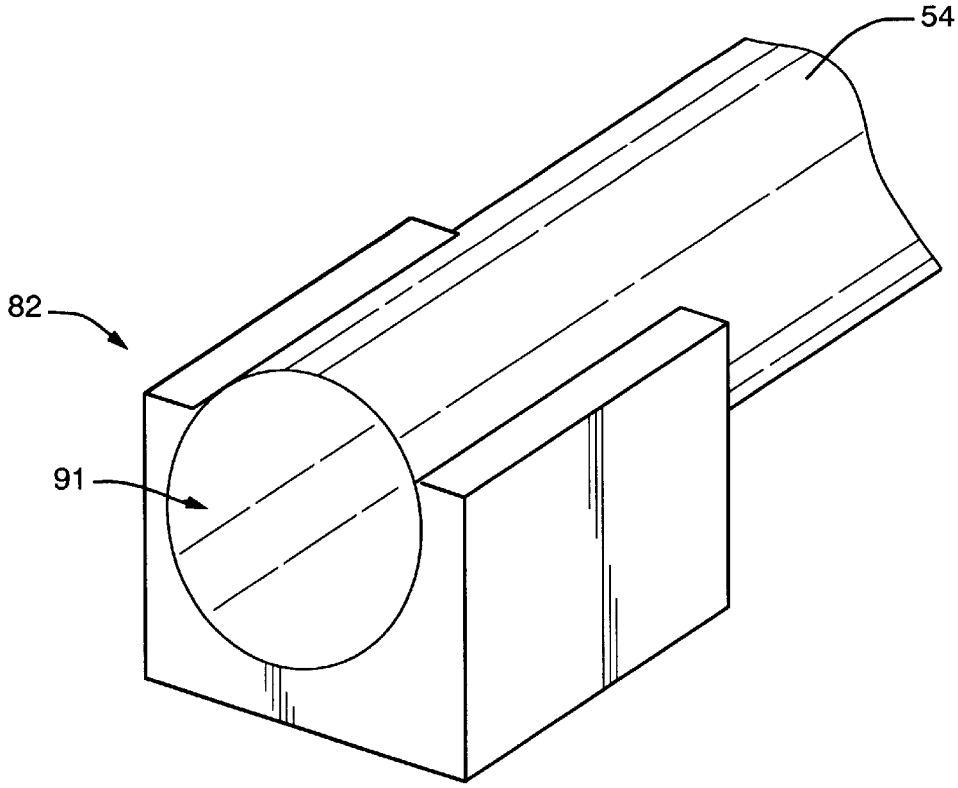
FIG. 5 is an exploded cut away view of the clamp of the rod assembly of FIG. 3.

Referring now to FIGS. 4 and 5, the preferred embodiments of the arm joint 80 and clamp 82 are shown. As shown in FIG. 4, the preferred arm joint 80 is manufactured of plastic and includes a clevis 81 and a plastic pin 83 that passes through mating holes in the clevis 81 and rod 54 and is secured to the clevis 81 such that the rod 54 is allowed to rotate within the clevis 81.

In the preferred embodiment, a second pin 87 is provided to limit the upward travel of the rod 54. This second pin 87 is disposed between two matching channels 89 at opposite sides of the clevis 81 and includes a series of locking details 93 into which the second pin 87 is moved in order to limit the upward travel of the rod 54. It is preferred that multiple details 93 be provided and that the maximum travel of the rod 54 is limited to a second position that is approximately forty-five degree angle from the base position of the rod. However, other embodiments utilize channels 89 without details 93. In these embodiments, the travel of the rod 54 is limited by the top limit of the channels 89. In still other embodiments, the second pin 87 and channels 89 are eliminated and the rod 54 is allowed to rotate freely.

It is likewise preferred that the rod 54 be biased upward. In the preferred embodiment, this is accomplished by the inclusion of a torsion spring (not shown) within the rod 54. This spring is fixed to the first pin 83 and biases the rod 54 upward. However, other embodiments may utilize other art-recognized means for biasing the rod 54, while still others eliminate this biasing feature altogether.

Although an arm joint 80 utilizing a pin 83 and clevis 81 is preferred, in other embodiments the arm joint 80 is a ball and socket type joint (not shown) that allows a broad range of motion. In still other embodiments, the arm joint 80 is replaced by a second clamp that allows the rod 54 to be completely removed from the apparatus and subsequently secured into position.

As shown in FIG. 5, the preferred clamp 82 is a plastic "C" type clamp. This clamp 82 is dimensioned to allow the rod 54 to be pressed into its opening 91 and holds the rod 54 in place. However, in other embodiments, the clamp 82 may include a clevis and removable pin that is inserted through the end of the rod 54 when the rod is placed into position. In still other embodiments, the clamp is a "J" hook style clamp (not shown) that is dimensioned to allow the rod 54 to be nested within the "J" portion of the clamp such that the rod is biased against the upward and sideward forces exerted by the garment. In some such embodiments, a plurality of "J" portions are provided in order to allow the rod 54 to be secured at different heights to accommodate garments of different thickness.

Referring now to FIG. 6, the apparatus 10 is shown in a closed position with portions of the exterior surface 35 of the housing 12 cut away to show the hanging means 84 and handle 86. As noted above, it preferred that the apparatus include at least one hanging means 84 for hanging the apparatus 10 during storage. In the preferred embodiment, two such hanging means 84 are rotatably attached to the exterior surface 35 of said housing 12. Such a rotatable hanging means 84 is preferred as this prevents the hanging means 84 from catching on objects during transport. As shown in FIG. 6, these hanging means 84 are positioned at two sides of the apparatus 10 to allow the apparatus 10 to be hung vertically or horizontally depending upon the size of the space. The hanging means 84 are preferably typical plastic coat hanger style hooks that include hinges that allow the hanging means 84 to fold into a pocket 95 in the housing 35. These hinges are preferably centered upon the housing to allow the apparatus to hang evenly. In other embodiments, the hanging means 84 are fixed in position, while in still other embodiments, the hanging means 84 is completely eliminated.

The preferred apparatus 10 also includes a handle 86. As shown in FIG. 6, the preferred handle 86 is also manufactured of plastic and is rotatably attached to the exterior surface 35 of the housing 12. The preferred handle includes hinge at the centerline of the housing 12 that allows the handle 86 to be centered when the apparatus 10 is carried by a user during transport. However, in other embodiments the handle 86 is fixedly attached to the side of the apparatus 10, while in still other embodiments, the handle 86 is completely eliminated.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A garment storage apparatus comprising:

a housing comprising a first portion having a first end and a first pair of sides, a second portion having a second end and a second pair of sides, and a central portion, wherein each of said first portion, said second portion and said central portion comprise an interior surface and an exterior surface, and wherein said first portion and said second portion are dimensioned to fold about said central portion and fasten together to form an interior compartment of said apparatus;

a clamp plate rotatably attached to said first end of said interior surface of said first portion of said housing;

clamping means for releasably engaging said clamp plate with said interior surface of said first portion of said housing; wherein said clamping means comprises a first rod assembly attached to said first interior surface of said first portion of said housing, said first clamp rod assembly comprising a first rod that is disposed at a position within said housing such that said first rod releasably engages said clamp plate with said interior surface of said first portion of said housing, a first adjustable arm joint, and a first clamp;

a central rod assembly attached to said interior surface of said central portion of said housing, said central rod assembly comprising a central rod disposed in substantially parallel relation with said second end of said second portion, said central rod being manufactured of a material that allows said central rod to hold a garment in tension when said first portion and said second portion are folded about said central portion;

a second rod assembly attached to said interior surface of said second portion of said housing, said second rod assembly comprising a second rod disposed in substantially parallel relation with said second end of said second portion of said housing, said second rod being manufactured of a material that allows said second rod to hold a garment in tension when said first portion and said second portion are folded about said central portion;

wherein a first end of a garment is disposed proximate to said clamp plate, a second end of said garment is fed below said central rod assembly and said second rod assembly and is also disposed proximate to said clamp plate, said clamp plate is engaged with said interior portion of said housing by said clamping means causing said first end and said second end of said garment to be secured, and said first portion and said second portion of said housing are folded about said central portion and fastened together to allow said garment to be transported within said interior of said housing in a substantially wrinkle free state.

2. The apparatus as claimed in claim 1 wherein said second rod assembly further comprises a second adjustable arm joint and a second clamp.

3. The apparatus as claimed in claim 1 wherein said central second rod assembly further comprises a central adjustable arm joint and a central clamp.

4. The apparatus as claimed in claim 2 wherein said central second rod assembly further comprises a central adjustable arm joint and a central clamp.

5. The apparatus as claimed in claim 4 wherein at least one of said first adjustable arm joint and second adjustable arm joint comprise a pin and clevis.

6. The apparatus as claimed in claim 4 wherein said central clamp is a C-style clamp.

7. The apparatus as claimed in claim 1 further comprising at least one hanging means for hanging said apparatus during storage.

8. The apparatus as claimed in claim 7 wherein said at least one hanging means is rotatably attached to said outside surface of said housing.

9. The apparatus as claimed in claim 8 wherein said at least one hanging means comprises two hanging means.

10. The apparatus as claimed in claim 1 further comprising a handle for carrying said apparatus during transport.

11. The apparatus as claimed in claim 10 wherein said handle is rotatably attached to said outside surface of said housing.

12. The apparatus as claimed in claim 1 wherein said first rod comprises a cover disposed about an outer surface of said first rod.

* * * * *